US006219509B1

(12) United States Patent
Komiya et al.

(10) Patent No.: US 6,219,509 B1
(45) Date of Patent: Apr. 17, 2001

(54) IMAGE FORMING APPARATUS SHIELDING CHARGING DEVICE AND AUXILIARY CHARGING DEVICE

(75) Inventors: Yoshiyuki Komiya; Atsushi Takeda, both of Mishima; Fumiteru Gomi, Shizuoka-ken; Kouichi Hashimoto, Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/479,213

(22) Filed: Jan. 7, 2000

(30) Foreign Application Priority Data

Jan. 12, 1999 (JP) ..... 11-005845

(51) Int. Cl.[7] ..... G03G 15/20
(52) U.S. Cl. ..... 399/168; 399/175; 399/176
(58) Field of Search ..... 399/168, 172, 399/174, 175, 176

(56) References Cited

U.S. PATENT DOCUMENTS 5,754,926 * 5/1998 Sakuraba et al. ..... 399/175
6,061,539 * 5/2000 Ishiyama et al. ..... 399/175

* cited by examiner

*Primary Examiner*—Quana M. Grainger
(74) *Attorney, Agent, or Firm*—Fitzpatrick, Cella, Harper & Scinto

(57) ABSTRACT

An image forming apparatus has an auxiliary charging device provided near a transfer device side of the charging device for charging an image forming apparatus including an image bearing member bearing an electrostatic image thereon. The charging device charges the image bearing member. The charging device constitutes electrically conductive magnetic particles in contact with the image bearing member to thereby effect charging. The image forming device forms an electrostatic image on the image bearing device charged by the charging device. A developing device develops the electrostatic image on the image bearing member using a toner. A transfer device transfers the toner image on the image bearing member to a transfer material. An auxiliary charging device provided near the transfer means side of the charging device charges the residual toner after transfer to a polarity opposite to a charging polarity of the charging device, wherein the magnetic particles temporarily collect the residual toner. A shield device shields the charging device and the auxiliary charging device.

5 Claims, 9 Drawing Sheets

IMAGE FORMING APPARATUS SHIELDING CHARGING DEVICE AND AUXILIARY CHARGING DEVICE

BACKGROUND OF THE INVENTION

1. Field of the Invention

This invention relates to an image forming apparatus such as a copier or a printer using the electrophotographic method or the electrostatic recording method.

2. Related Background Art

FIG. 10 shows an example of an image forming apparatus.

In the image forming apparatus of FIG. 10, when a copy (image formation) starting signal is inputted, a photosensitive drum 1 is uniformly charged to a predetermined potential by a charging device 3. On the other hand, a unit 9 comprising an original irradiating lamp, a short-focus lens array and a CCD sensor constructed integrally with one another scans an original G placed on an original supporting table 10 while irradiating the original G, whereby the reflected light of the irradiating scanning light from the surface of the original is imaged by the short-focus lens array and enters the CCD sensor. The CCD sensor is comprised of a light receiving portion, a transferring portion and an output portion. In the light receiving portion of the CCD, an optical signal is changed into a charge signal, which is sequentially transferred to the output portion by the transferring portion in synchronism with a clock pulse, is converted into a voltage signal in the output portion, is amplified and made into low impedance, and is outputted. An analog signal thus obtained is subjected to well known image processing and is converted into a digital signal, and is sent to a printer portion. In the printer portion, an electrostatic latent image corresponding to the image of the original is formed on the surface of the photosensitive drum 1 by laser exposing means 2 which scans the light L of a solid state laser element emitting light in response to the above-mentioned image signal by a rotatable polygon mirror rotated at a high speed.

Next, this electrostatic latent image is developed by a developing device 4 containing therein a so-called two-component developer having toner particles and carrier particles, whereby a toner image is formed on the photosensitive drum 1.

The toner image formed on the photosensitive drum 1 in this manner is electrostatically transferred onto a transfer material P by a transfer device 7. Thereafter, the transfer material P is electrostatically separated from the surface of the photosensitive drum 1 and is conveyed to a fixing device 6, whereby the toner image on the transfer material P is thermally fixed, and the transfer material P is discharged out of the main body of the image forming apparatus.

On the other hand, after the transfer of the toner image, any toner not transferred to the transfer material P but remaining on the surface of the photosensitive drum 1 (residual toner after transfer) (untransferred toner) is removed by a cleaner 5, and any charge on the photosensitive drum 1 is eliminated by a pre-exposure device 8, and the photosensitive drum 1 is used for the next image forming process.

Also, in recent years, there has appeared a cleanerless image forming apparatus in which the cleaner 5 is detached and cleaning simultaneous with development is effected by the developing device 4. The cleaning simultaneous with development is a method of collecting the residual toner after transfer remaining on the photosensitive drum 1 after the transfer into the developing device 4 by a fog removing bias during the development at the next and subsequent steps. Thereby, the residual toner after transfer is collected and is also used after the next step and therefore, any waste toner can be made null. Also, the merit in terms of space is great and the apparatus can be made greatly compact.

Further, from merits such as low ozone and low electric power, a contact charging device, i.e., a device of a type in which a charging member, to which a voltage is applied, is made to abut against the photosensitive drum 1 as a member to be charged to thereby charge the surface of the photosensitive drum 1 has been put into practical use as charging means for the photosensitive drum 1.

As the contact charging device of such a type, a device of the magnetic brush type (hereinafter referred to as the magnetic brush charging device) is preferably used from the viewpoint of the stability of charging contact.

In the magnetic brush charging device, electrically conductive magnetic particles are directly magnetically restrained on a magnet or on a sleeve containing a magnet therein to thereby construct a magnetic brush as a charging member, and the magnetic particles is brought into contact with a member to be charged in its stopped state or its rotated state, and a voltage is applied thereto to thereby effect charging.

Also, a member comprising electrically conductive fibers formed into a brush-like shape (hereinafter referred to as the "fur brush") or an electrically conductive rubber roller comprising electrically conductive rubber made into a roll-like shape is preferably used as a contact charging member.

Particularly, when such a contact charging member is used and as a member to be charged, use is made of an ordinary organic photosensitive member having a surface having electrically conductive fine particles dispersed therein, or an amorphous silicon photosensitive member or the like, it is possible to obtain on the surface of the member to be charged a charging potential substantially equal to a DC component of a bias applied to the contact charging member. Such a charging method is called injection charging. According to this injection charging, the charging of the member to be charged does not utilize the discharging phenomenon when a corona charger is used and therefore, completely ozoneless and low electric power consumption type charging becomes possible, and attention has been attracted thereto.

However, when such an image forming apparatus is not provided with a cleaner and the collection simultaneous with development by the developing device 4 is effected and image formation is repeated, if the residual toner after transfer cannot be completely collected by the developing device 4, a so-called "positive ghost" in which the previous image remains thinly has sometimes occurred. This positive ghost is a phenomenon occurring because when the surface of the photosensitive drum 1 passes the contact charging member, that portion of the surface of the photosensitive drum 1 which is under the residual toner after transfer, i.e., to which the residual toner after transfer adheres, cannot be charged, and it will become more remarkable when the contact charging member is contaminated.

So, in order to charge this portion which is under the residual toner after transfer during charging, it becomes important to once scrape off the residual toner after transfer from the surface of the photosensitive drum 1 during charging, and return it to the surface of the photosensitive drum 1 after charging, and thereafter collect it by the developing device 4.

In this case, means for causing an electrically conductive brush 11 as shown in FIG. 11 of the accompanying drawings to abut as auxiliary means against the portion on the surface of the photosensitive drum 1 between the transfer device 7 and the charging device 3, and applying a bias opposite in polarity to the charging bias by the charging device 3 to thereby make the residual toner after transfer easy to introduce into the charging device 3, and preventing the afore-described positive ghost from occuring. In FIG. 11, the reference numeral 31 designates a magnet roller (magnetic particle bearing member) rotated in the direction of arrow R3, the reference numeral 32 denotes a regulating blade, the reference numeral 33 designates a magnetic carrier (magnetic particles) borne on the surface of the magnet roller 31 and contacting with the surface of the photosensitive drum 1, and the reference numeral 34 denotes a charging bias applying power source for applying a charging bias to the magnet roller 31.

However, when the repetition of image formation or image formation of high image percentage is effected or when transfer efficiency is aggravated in a low humidity environment or the like, there has been the problem that the toner adheres to the end portion of the electrically conductive brush and the toner gets mixed in the charging device 3 or drops onto the transfer material P. There has also been the problem that by the rotation of the photosensitive drum 1, the electrically conductive brush becomes gradually inclined and interferes with the charger 3 to which a bias of the opposite polarity has been applied.

SUMMARY OF THE INVENTION

It is an object of the present invention to provide an image forming apparatus in which any residual toner after transfer can be collected by a charging device.

It is another object of the present invention to provide an image forming apparatus in which an auxiliary charging device can be provided in proximity to a charging device.

It is still another object of the present invention to provide an image forming apparatus in which a charging device and an auxiliary charging device are prevented from interfering with each other.

It is yet still another object of the present invention to provide an image forming apparatus comprising:

- an image bearing member bearing an electrostatic image thereon;
- charging means for charging the image bearing member;
- said charging means being electrically conductive magnetic particles in contact with said image bearing member to thereby effect charging;
- image forming means for forming an electrostatic image on the image bearing member charged by the charging means;
- developing means for developing the electrostatic image on the image bearing member by a toner;
- transfer means for transferring the toner image on the image bearing member to a transfer material;
- auxiliary charging means provided near the transfer means side of the charging means for charging the residual toner after transfer to a polarity opposite to a charging polarity of said charging means, wherein the magnetic particles temporarily collect the residual toner; and
- a shield member for shielding the charging means and the auxiliary charging means.

Further objects of the present invention will become apparent from the following description.

DESCRIPTION OF THE PREFERRED EMBODIMENTS

Figure 1:
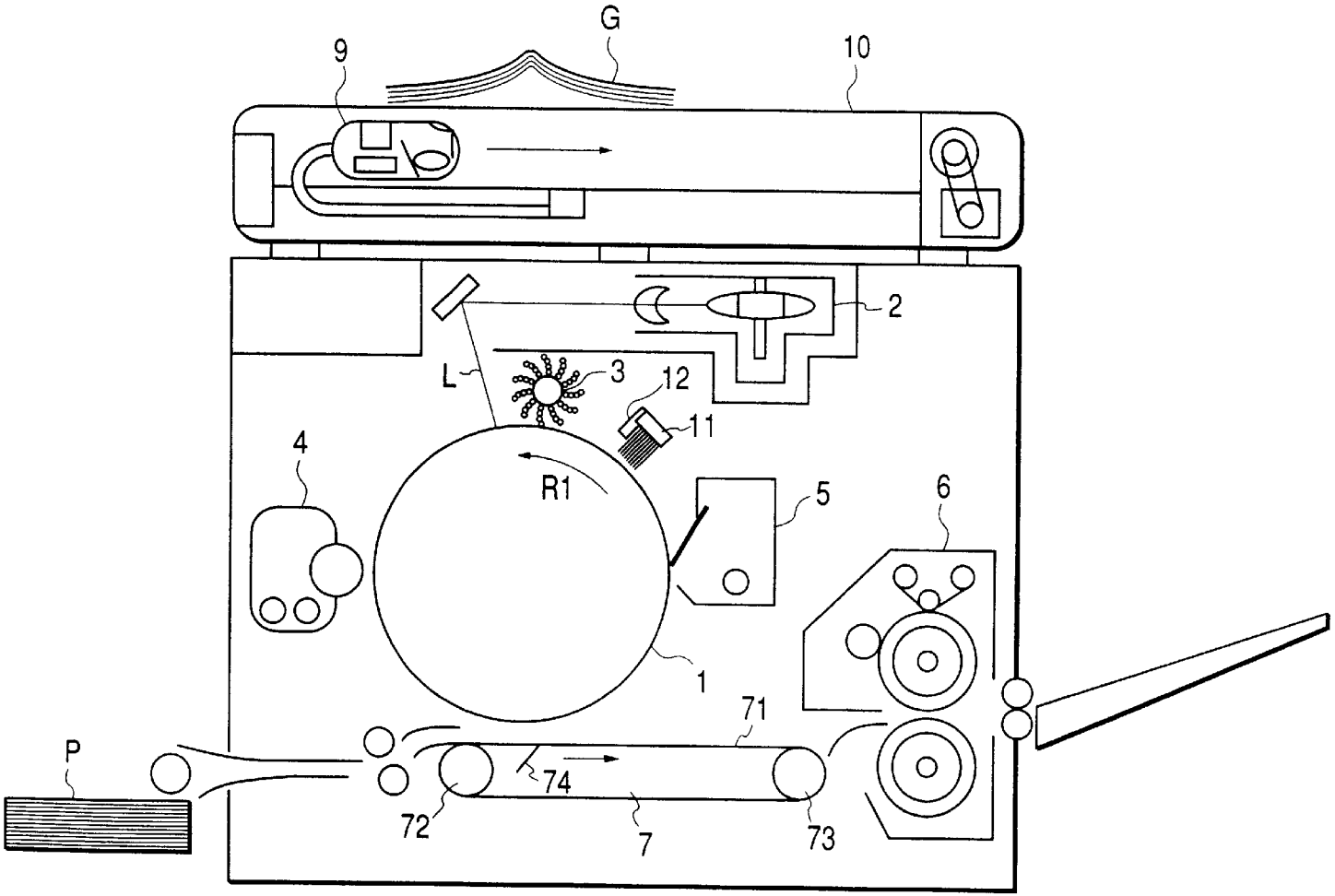
FIG. 1 is a longitudinal cross-sectional view schematically showing the construction of an image forming apparatus according to Embodiment 1.

FIG. 1 shows an embodiment of an image forming apparatus according to the present invention. FIG. 1 is a longitudinal cross-sectional view schematically showing the construction of a laser beam printer.

The image forming apparatus shown in FIG. 1 is provided with a drum-shaped electrophotographic photosensitive member (hereinafter suitably referred to as the "photosensitive drum") as an image bearing member.

As the photosensitive drum 1 used in the present invention, use can be made of a usually used organic photosensitive member or the like, and when desirable, use is made of an organic photosensitive member having a surface layer of a material having resistance of $10^2$ to $10^{14}\Omega\cdot$cm, or an amorphous silicon photosensitive member or the like, charge injection charging can be realized, and this is effective to prevent the creation of ozone and reduce the consumed electric power. Also, the charging property can be improved. So, in the present embodiment, use is made of a photosensitive drum 1 which is a negatively charged organic photosensitive member comprising a drum base of aluminum having a diameter of 30 mm and the following first to fifth layers provided thereon in succession from the inside.

The first layer is an undercoating layer, and more particularly an electrically conductive layer having a thickness of 20 $\mu$m provided to level the defect or the like of an aluminum base as the drum base.

The second layer is a positive charge injection preventing layer, and more particularly a medium-resistance layer having a thickness of 1 $\mu$m which performs the role of preventing positive charges injected from the aluminum base from negating negative charges charged on the surface of the photosensitive member and of which the resistance is adjusted to the order of $1\times10^6\Omega\cdot$cm by amylan resin and methoxymethylated nylon.

The third layer is a charge producing layer, and more particularly a layer having a thickness of about 0.3 $\mu$m having a disazo pigment dispersed in resin, and produces a pair of positive and negative charges by being subjected to exposure.

The fourth layer is a charge transporting layer, and more particularly a P-type semiconductor comprising hydrazon dispersed in polycarbonate resin. Accordingly, negative charges charged on the surface of the photosensitive member cannot move through this layer, and only positive charges produced in the charge producing layer can be transported to the surface of the photosensitive member.

The fifth layer is a charge injecting layer, and more particularly a coating layer of a material comprising electrically conductive $SnO_2$ ultrafine particles dispersed in a binder of insulative resin. Specifically, it is a coating layer of a material comprising $SnO_2$ particles having a particle diameter of about 0.03 $\mu$m made low in resistance (electrically conductive) by antimony which is a light transmitting insulative filler being doped into insulative resin and dispensed in resin at 70% by weight.

The coating liquid thus prepared was applied to a thickness of about 3 $\mu$m by a suitable coating method such as a dipping coating method, a spray coating method, a roll coating method or a beam coating method to thereby make a charge injecting layer. The surface resistance is $10^{13}\Omega\cdot$cm. By thus controlling the surface resistance, the charging property is improved and images of high dignity can be obtained. The photosensitive member is not restricted to OPC, but can also be realized by an a-Si drum, and further, high durability can be realized.

Here, the volume resistance of the surface layer is a value measured by disposing metallic electrodes at intervals of 200 $\mu$m, flowing the prepared liquid of the surface layer into the space between them to thereby form a film, and applying a voltage of 100V to between the electrodes. The measurement is a value measured under the conditions of temperature 23° C. and humidity 50% RH.

The photosensitive drum 1 of the above-described construction is rotatively driven in the direction of arrow R1 by driving means (not shown).

The photosensitive drum 1 has its surface charged by a magnetic brush charging device 3.

Figure 2:
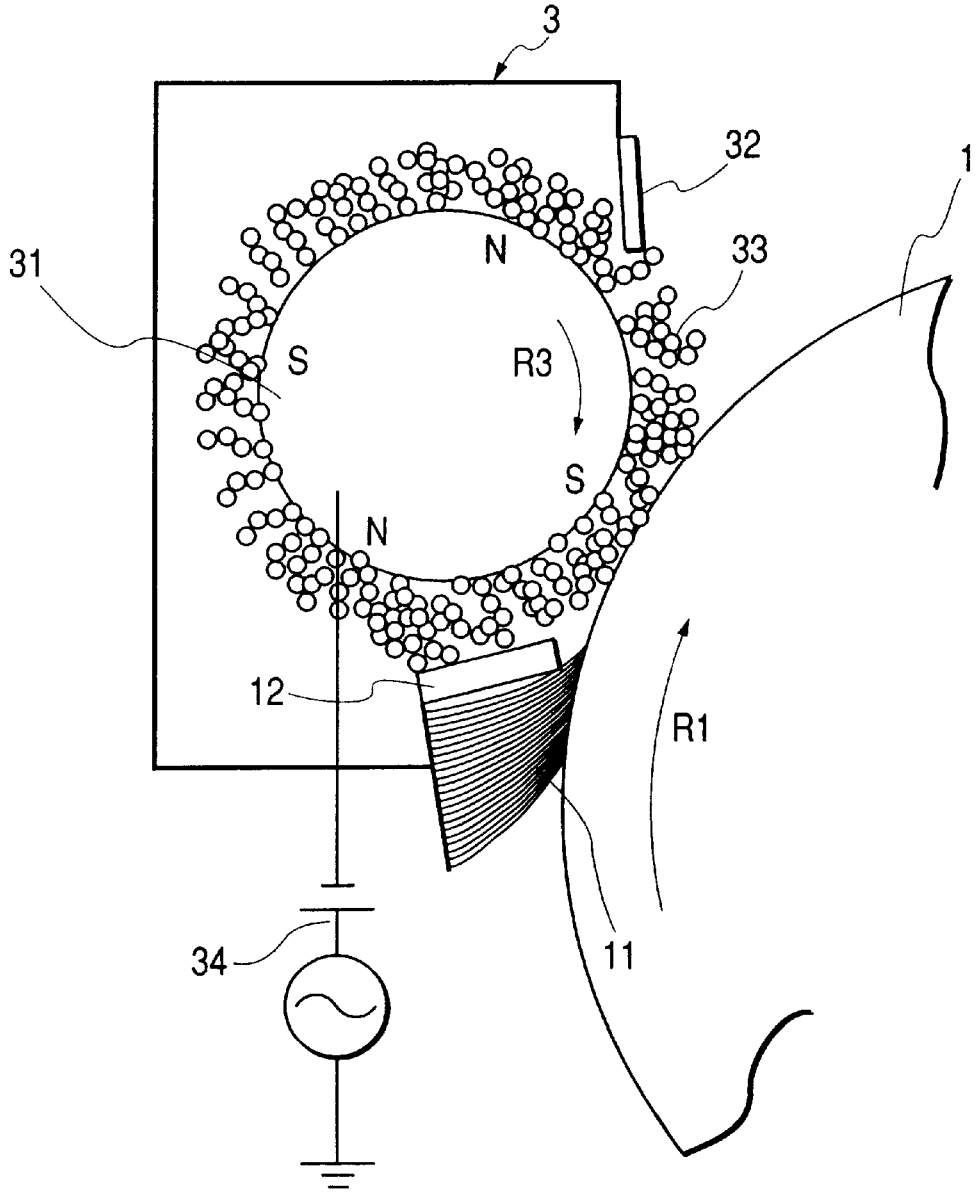
FIG. 2 shows the constructions of a magnetic brush charging device, an electrically conductive brush and a shield member in Embodiment 1.

The charging device used in the present embodiment is a magnetic brush charging device 3 using a magnetic carrier, as shown in FIG. 2. The surface of a charging sleeve (magnetic particle bearing member) 31 having magnetism and rotated in the direction of the arrow bears a magnetic carrier (magnetic particles) 33 thereon, and the thickness of the magnetic carrier 33 is adapted to be regulated by a regulating blade 32. The charging sleeve 31 and the magnetic carrier 33 together constitute a contact charging member. The magnetic carrier 33 for magnetic charging may preferably have an average particle diameter of 10 to 100 $\mu$m, a saturated magnetization of 20 to 250 emu/cm$^3$ and a resistance of $1\times10^2$ to $1\times10^{10}\Omega\cdot$cm, and more preferably a resistance of $1\times10^6\Omega\cdot$cm or greater when it is taken into account that a defect of insulation such as a pinhole is present in the photosensitive drum 1. To make the charging performance good, use may preferably be made of a magnetic carrier having the smallest possible resistance, and in the present embodiment, use is made of magnetic particles having an average particle diameter of 25 $\mu$m, a saturated magnetization of 200 emu/cm$^3$ and resistance of $5\times10^6\Omega\cdot$cm. Also, the magnetic carrier for charging used in the present embodiment is such that the surface of ferrite has been oxidized and reduced to thereby adjust the resistance thereof.

Charges are injected into the surface of the photosensitive drum 1 through the magnetic carrier 33 by a charging bias being applied to the charging roller 31 by a charging bias applying power source 34. Thereby, the surface of the photosensitive drum 1 is uniformly charged to a predetermined polarity and predetermined potential.

After the charging, the surface of the photosensitive drum 1 is exposed by laser exposure means (exposure means) 2.

A unit 9 comprising an original irradiating lamp, a short-focus lens array and a CCD sensor constructed integrally with one another scans an original G placed on an original supporting table 10 while irradiating the original G, whereby the reflected light of the irradiating scanning light from the surface of the original is imaged by the short-focus lens array and enters the CCD sensor. The CCD sensor is comprised of a light receiving portion, a transmitting portion and an output portion. In the light receiving portion of the CCD sensor, the light signal is changed into a charge signal, which is sequentially transmitted to the output portion in synchronism with a clock pulse by the transmitting portion, and is converted into a voltage signal in the output portion, and is amplified and is made into low impedance and is outputted. An analog signal thus obtained is subjected to well-known image processing and is converted into a digital signal, and is sent to a printer portion. In the printer portion, an electrostatic latent image corresponding to the image of the original is formed on the surface of the photosensitive drum 1 by the laser exposure means 2 scanning the light L of a solid state laser element turned on and off in response to the above-described image signal by a rotatable polygon mirror rotated at a high speed.

The electrostatic latent image is developed by a developing device 4.

Generally, the developing method is divided broadly into four kinds, i.e., (1) a method of applying a nonmagnetic toner onto a developing sleeve by a blade or the like, or applying a magnetic toner onto the developing sleeve by a magnetic force and carrying the magnetic toner and developing in a noncontact state with the photosensitive drum (one-component noncontact development), (2) a method of developing the toner applied in the above-described manner in a contact state with the photosensitive drum (one-component contact development), (3) a method of using toner particles having a magnetic carrier mixed therewith as a developer and carrying it by a magnetic force and developing in a contact state with the photosensitive drum (two-component contact development), and (4) a method of developing with the above-mentioned two-component developer brought into a non-contact state (two-component non-contact development). The two-component contact developing method has been often used from the viewpoint of the higher quality and higher stability of images.

Figure 3:
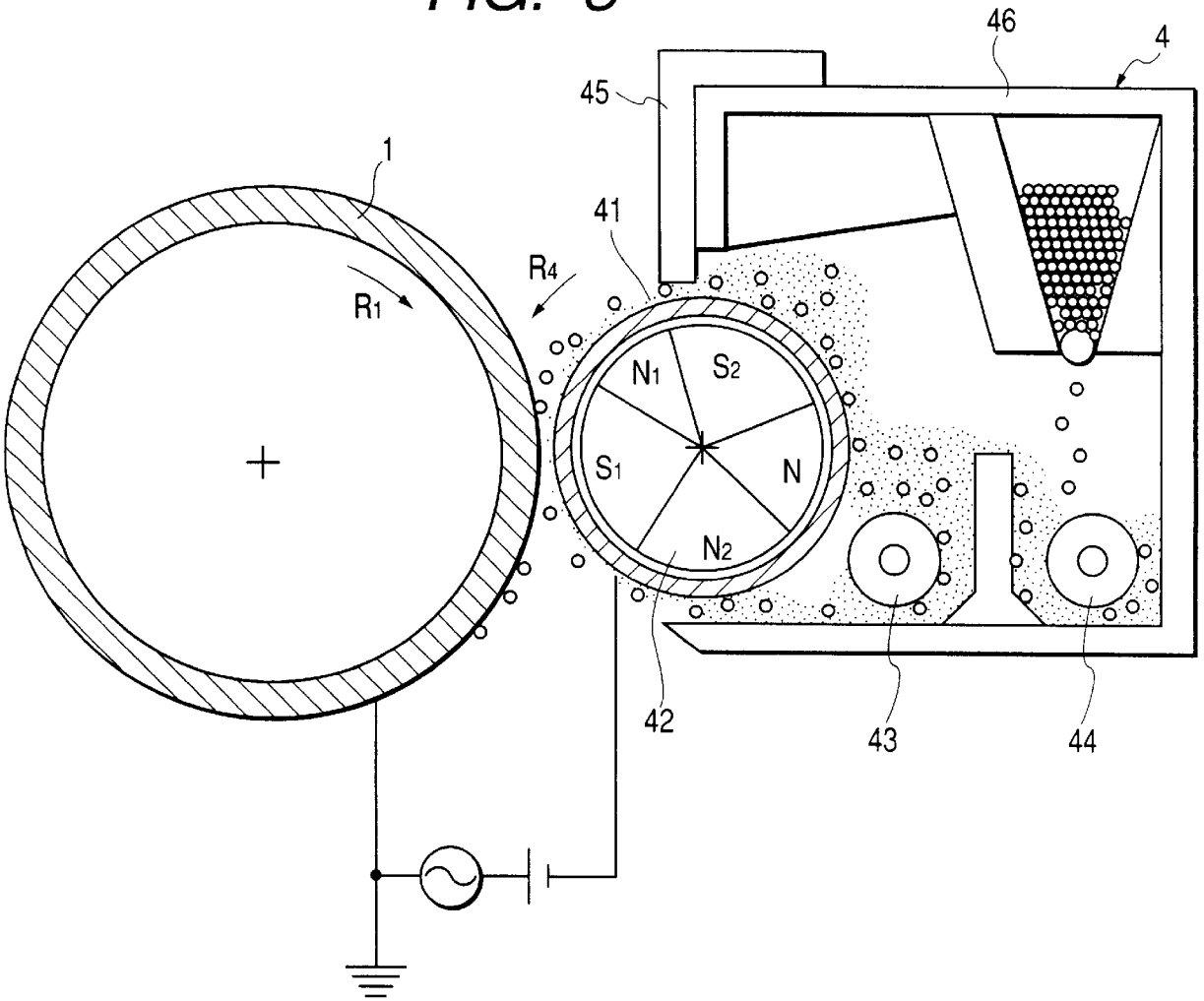
FIG. 3 shows the construction of a developing device in Embodiment 1.

FIG. 3 is a schematic view of the developing device 4 for two-component magnetic brush development used in the present embodiment. In FIG. 3, the reference numeral 41 denotes a developing sleeve, the reference numeral 42 denotes a magnet roller fixedly disposed in the developing sleeve 41, the reference numerals 43 and 44 designate agitating screws, the reference numeral 45 denotes a regulating blade for forming a thin layer of the developer on the surface of the developing sleeve 41, and the reference numeral 46 designates a developing container. The developing sleeve 41 is disposed so that at least during development, its nearest area to the photosensitive drum 1 may be about 500 $\mu$m, and is set so that development can be done with the developer being in contact with the photosensitive drum 1. The two-component developer used in the present embodiment consists of toner particles comprising titanium oxide having an average particle diameter of 20 nm extraneously added by a weight ratio of 1% to a negatively charged toner having an average particle diameter of 6 $\mu$m, and a magnetic carrier for development having saturated magnetization of 205 emu/cm$^3$ and having an average particle diameter of 35 $\mu$m. Also, a mixture of this toner and this magnetic carrier for development at a weight ratio of 6:94 was used as the developer. The toner in the developer at this time had a triboelectric charging amount of about $25\times10^{-3}$C/kg.

A description will now be made of the developing step of visualizing the electrostatic latent image by a two-component magnetic brush method by the use of the developing device 4 and a circulating system for the developer.

First, the developer drum up by a pole N2 with the rotation of the developing sleeve 41 is regulated by the regulating blade 45 disposed perpendicularly to the developing sleeve 41 in the process of being carried from the pole N2 to a pole N1, and is formed as a thin layer on the developing sleeve 41. When the developer formed as the thin layer is carried to a main developing pole S1, an ear is formed by a magnetic force. The electrostatic latent image is developed by the developer formed into the shape of ear, whereafter by the repulsing magnetic field of the poles N2 and N, the developer on the developing sleeve 41 is returned into the developing container 46.

A DC voltage and an AC voltage are applied from a voltage source, not shown, to the developing sleeve 41, and in the present embodiment, −480V is applied as the DC voltage and a peak-to-peak voltage $V_{PP}$=1500V and a frequency Vf=3000 Hz are applied as the AC voltage. Generally in the two-component developing method, when an AC voltage is applied, the developing efficiency increases and images become high in dignity, but there occurs the risk that fog becomes liable to occur. Therefore, usually, the prevention of fog is realized by providing a potential difference between the DC voltage applied to the developing device 4 and the surface potential of the photosensitive drum 1. This potential difference for the prevention of fog is called fog removing potential $V_{back}$, and by this potential difference, the toner is prevented from adhering to a nonimage area during development.

The toner is attached to the electrostatic latent image on the surface of the photosensitive drum 1 by the developing device 4 of the above-described construction and is developed as a toner image.

This toner image on the photosensitive drum 1 is transferred to a transfer material P by a transfer device (transfer means) 7.

The transfer device 7 comprises an endless transfer belt 71 extended between a drive roller 72 and a driven roller 73 and moved round in the direction of arrow indicated in FIG. 1. The transfer device 7 is further provided with a transfer charging blade 74 therein, and the transfer charging blade 74 presses the transfer belt 71 from the inner side thereof toward the photosensitive drum 1, and a transfer bias is applied to the transfer belt by a high voltage source (not shown), whereby charging opposite in polarity to the toner image on the photosensitive drum 1 is effected from the back side of the transfer material P. Thereby, the toner image on the photosensitive drum 1 is sequentially transferred onto the transfer material P. The transfer material P is conveyed from a sheet feeding device to the transfer portion between the photosensitive drum 1 and the transfer belt 71 in properly timed relationship with the rotation of the photosensitive drum 1.

In the present embodiment, a transfer belt formed of polyimide resin having film thickness of 75 $\mu$m is used as the transfer belt 71. The material of the transfer belt 71 is not restricted to polyimide resin, but use can suitably be made of plastic such as polycarbonate resin, polyethylene terephthalate resin, polyvinylidene fluoride resin, polyethylene naphthalate resin, polyether ether kent resin, polyether sulfone resin or polyurethane resin, or fluorine or silicon rubber. The thickness of the transfer belt is neither restricted to 75 $\mu$m, but use can be made of 25 to 2000 $\mu$m, or preferably 50 to 150 $\mu$m.

Further, the transfer charging blade 74 has resistance of $1\times10^5$ to $1\times10^7\Omega$. Transfer was effected with a bias of +15 $\mu$A applied to this transfer charging blade 74 by constant current control.

In this manner, the toner image on the photosensitive drum 1 is electrostatically transferred onto the transfer material P by the transfer charging blade 74.

Thereafter, the transfer material P is conveyed to a fixing device 6, where the toner image is thermally fixed on the surface of the transfer material P, whereafter the transfer material P is discharged out of the main body of the image forming apparatus.

On the other hand, some residual toner after transfer remains on the surface of the photosensitive drum 1 after the transfer of the toner image. If this residual toner after transfer is intactly made to pass the charging device 3, there will occur a phenomenon(ghost) in which the charging potential lowers only in those portions of the surface of the photosensitive drum 1 on which the residual toner after transfer is present or the previous image portion appears thinly or thickly on the next image. Even if the residual toner after transfer passes the magnetic brush charging device 3 in contact with the surface of the photosensitive drum 1, the shape of the previous image will be left in almost all cases.

So, it becomes necessary to introduce the residual toner after transfer having arrived at the charging area into the magnetic brush charging device 3 with the rotation of the photosensitive drum 1, and erase the hysteresis of the previous image. In this case, a DC voltage is only applied to the magnetic brush charging device 3, the introduction of the toner into the charging device will not be effected sufficiently, but if an alternating voltage is applied to the magnetic brush charging device 3, the introduction of the toner into the charging device will be effected easily by the vibration effect of the electric field between the photosensitive drum and the charging device. Here, it is often the case with the residual toner after transfer on the photosensitive drum 1 that particles of the positive polarity and particles of the negative polarity are mixedly present due to the peel discharge during transfer, but when the ease of the introduction of the toner into the magnetic brush charging device 3 is taken into account, it is desirable that the residual toner after transfer be charged to the positive polarity.

In the present embodiment, as shown in FIG. 1, the electrically conductive brush 11 is made to abut against that portion of the surface of the photosensitive drum 1 which is between the transfer device 7 and the magnetic brush charging device 3, and a bias opposite in polarity to the charging bias is applied to that portion. Of the residual toner after transfer borne on the surface of the photosensitive drum 1, the residual toner after transfer of the positive polarity passes the magnetic brush charging device 3 and the residual toner after transfer of the negative polarity is temporarily caught by the electrically conductive brush 11, and has its charges eliminated, whereafter it is again sent onto the photosensitive drum 1. Thereby, the residual toner after transfer becomes easier to introduce toward the magnetic brush, and the factor by which the ghost occurs is eliminated.

However, when the magnetic brush charging device 3 scrapes off the residual toner after transfer on the photosensitive drum 1, there occurs the phenomenon that scattered residual toner after transfer adheres to and accumulates on that end portion of the electrically conductive brush 11 which is adjacent to the magnetic brush charging device 3. The toner accumulating on that end portion of the electrically conductive brush 11 which is adjacent to the magnetic brush charging device 3 sometimes gets mixed in the magnetic brush charging device 3 by the vibration during the detachment or movement of a process instrument. When a predetermined amount of or more toner gets mixed in the magnetic brush charging device 3, although depending on the resistance value or the like of the toner, the photosensitive drum 1 cannot be charged to the desired potential and bad images will be created even if an alternating voltage is superposed. Also, the electrically conductive brush 11 abuts against and is rotated with the photosensitive drum 1 and therefore, with the rotation of the photosensitive drum 1, the brush becomes inclined toward the magnetic brush charging device 3 side. When the free length of the electrically conductive brush 11 is made long or the amount of entry thereof is made great, the inclination of the brush hair becomes more remarkable. The bias applied to the magnetic brush charging device 3 and the bias applied to the electrically conductive brush 11 are opposite in polarity to each other and therefore, it is feared that the electrically conductive brush 11 is inclined to thereby contact and interfere with the magnetic brush charging device 3.

Figure 4:
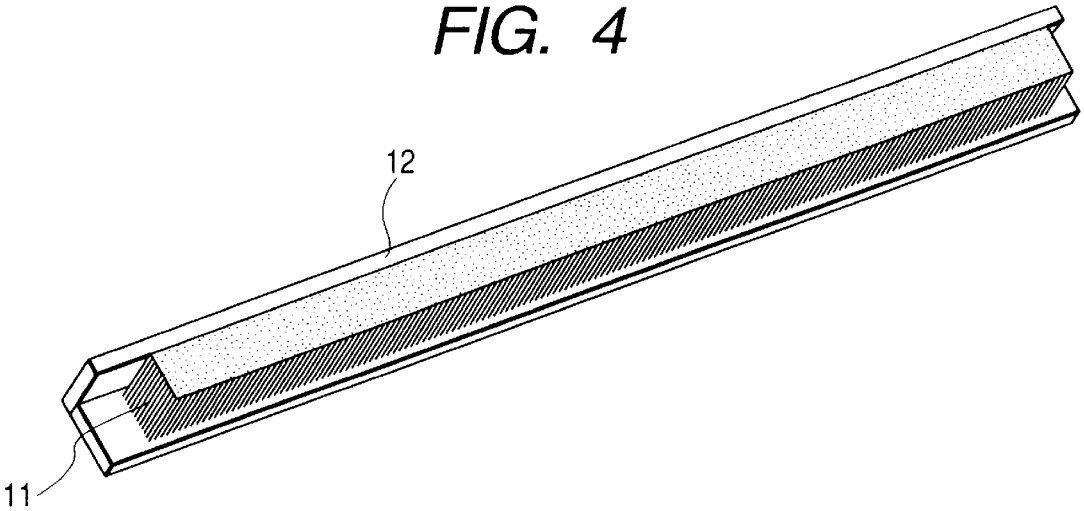
FIG. 4 is a perspective view showing the constructions of a magnetic brush and the shield member in Embodiment 1.

So, in the present embodiment, as shown in FIG. 4, an electrically nonconductive shield member (first shield member) 12 is stood on that side of the electrically conductive brush 11 which is adjacent to the magnetic brush charging device 3. Further, a construction as shown in FIG. 2 wherein the ear of the magnetic carrier 33 in the magnetic brush charging device 3 and the shield member 12 are in light contact with each other is desirable. Thereby, the toner scattered and adhering onto the shield member 12 when the magnetic brush charging device 3 scrapes off the residual toner after transfer on the photosensitive drum 1 is not piled on the end portion of the electrically conductive brush 11 but is sequentially scraped off by the magnetic carrier 33 in the magnetic brush charging device 3, and a great deal of toner can be prevented from getting mixed in the magnetic brush charging device at a time by vibration or the like. Further, the shield member 12 has the role of a screen between the magnetic brush charging device 3 and the electrically conductive brush 11 and suppresses the inclination of the electrically conductive brush 11 toward the magnetic brush charging device 3 and therefore, can prevent the interference between the magnetic brush charging device 3 and the electrically conductive brush 11.

When an image forming duration test was carried out by the construction as described above, the inconvenience experienced in the prior-art construction that the toner piled on the electrically conductive brush 11 gets mixed in the magnetic brush charging device 3 by vibration or the like was avoided, and it became possible to maintain stable image formation for a long period of time.

Embodiment 2

Figure 5:
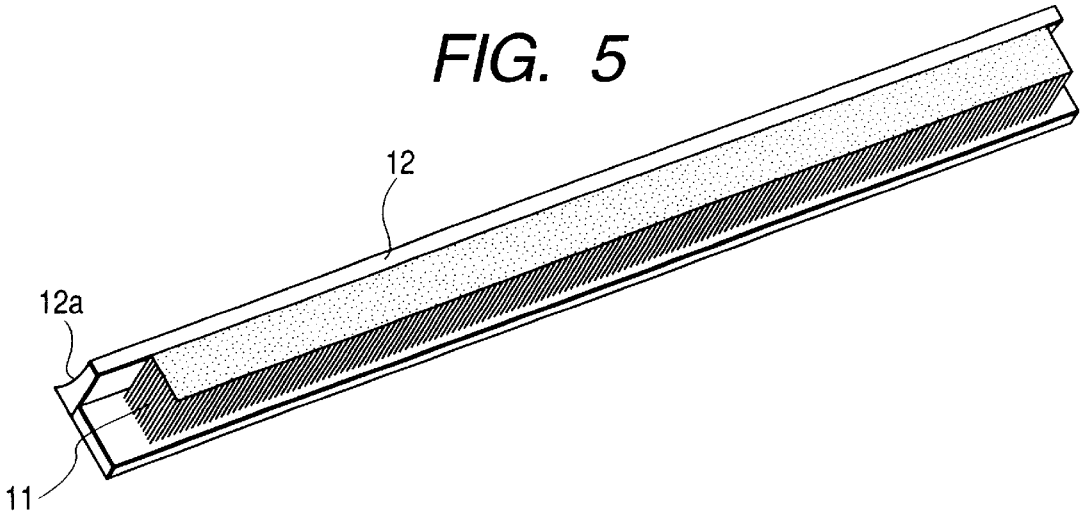
FIG. 5 is a perspective view showing the constructions of a magnetic brush and a shield member in Embodiment 2.
Figure 6:
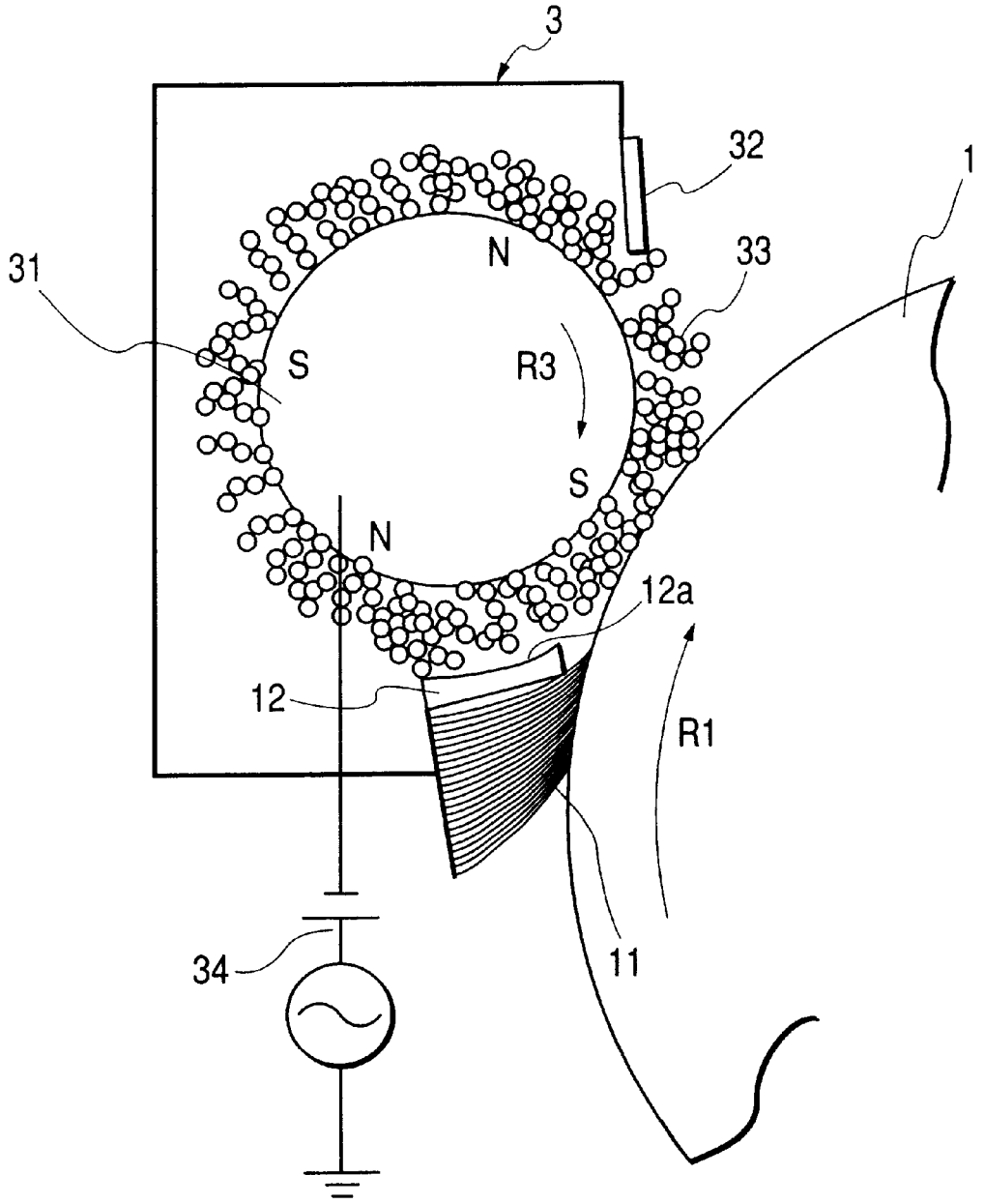
FIG. 6 shows the constructions of a magnetic brush charging device, an electrically conductive brush and the shield member in Embodiment 2.

FIG. 5 is a perspective view of a shield member 12 in Embodiment 2. This embodiment differs in the shape of the shield member 12 from the above-described Embodiment 1. That is, in Embodiment 1, the cross-sectional shape of the shield member 12 in a direction orthogonal to the lengthwise direction thereof is a rectangular shape, but in Embodiment 2, as shown in FIGS. 5 and 6, that surface of the shield member 12 which is adjacent to the magnetic brush charging device 3 is formed into an arcuately curved surface 12*a* along the direction of movement of the magnetic carrier 33. By the curved surface 12*a* being thus constructed so that the ear of the magnetic carrier 33 in the magnetic brush charging device 3 may lightly contact with it, the scraping-off of the toner by the magnetic brush charging device 3 can be expedited. In the other points, the construction of the present embodiment is similar to that of the aforedescribed Embodiment 1.

Thus, the toner which has scattered and adhered to the shield member 12 when the magnetic brush charging device 3 scrapes off the residual toner after transfer on the photosensitive drum 1 does not accumulate on the end portion of the electrically conductive brush 11 but may be sequentially scraped off by the magnetic brush of the magnetic brush charging device, and a great deal of toner can be prevented from getting mixed in the magnetic brush charging device at a time by vibration or the like.

Embodiment 3

When image formation is effected by the image forming apparatus as shown in FIG. 1, a bias is applied to the electrically conductive brush 11 and therefore, the residual toner after transfer electrically adheres to that end portion of the electrically conductive brush 11 which is adjacent to the transfer device 7. The amount of adherence becomes remarkably great when image formation of high image percentage is effected or when the transfer efficiency is aggravated by the fluctuation of the environment and the quantity of the untransferred toner becomes great, or further when the toner scatters around the transfer device 7. This adhering toner drops by the vibration during the detachment or movement of the process instrument when the amount of charge (Q/M) per unit weight is lowered by a variation in the environment or the apparatus being left as it is and therefore, if the process instrument is a process cartridge detachably attachable to the main body of the image forming apparatus, it is feared that a user's hands are stained during the interchange thereof. Also, a poor image will be provided when during image formation, the toner drops onto the transfer material P on the transfer device 7.

Figure 7:
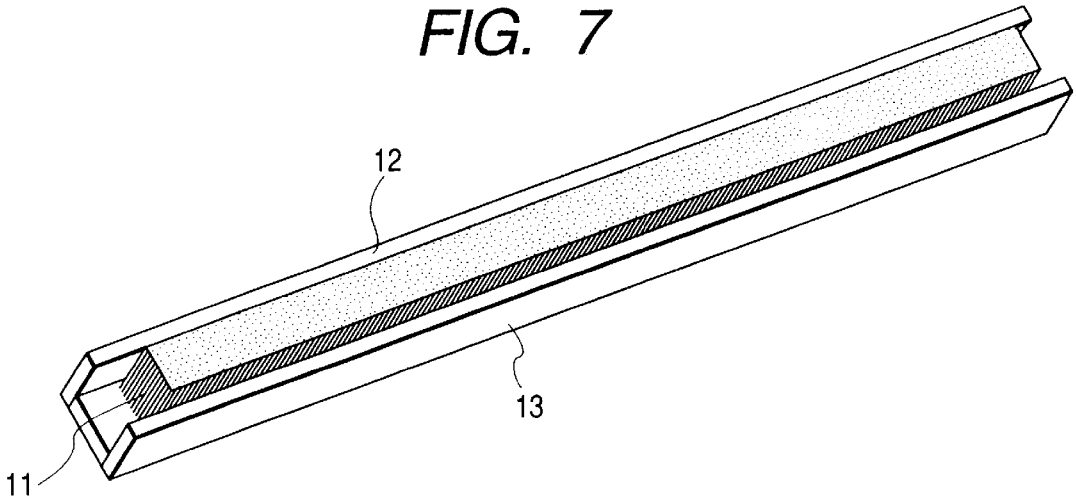
FIG. 7 is a perspective view showing the constructions of a magnetic brush and a shield member in Embodiment 3.
Figure 8:
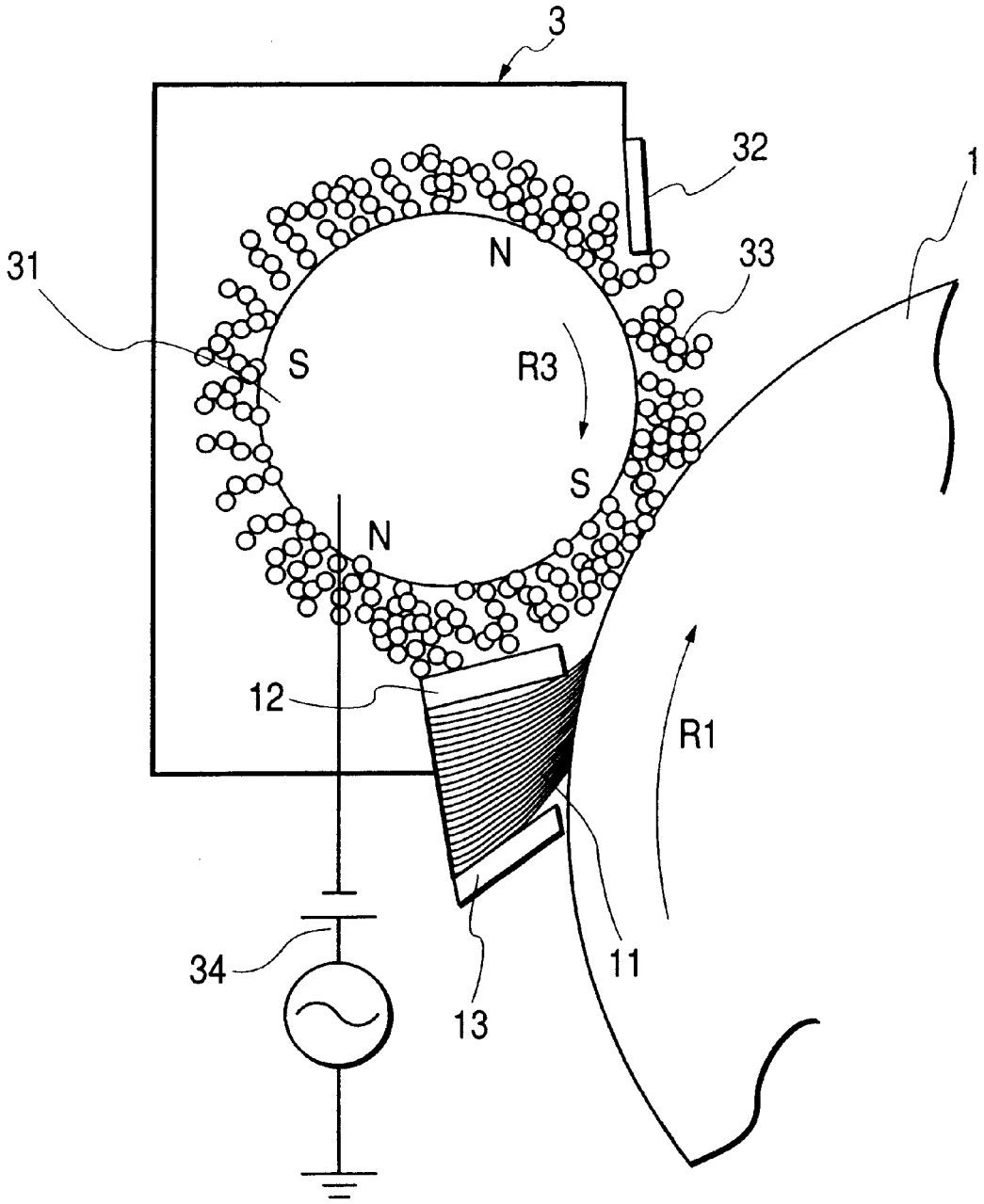
FIG. 8 shows the constructions of a magnetic brush charging device, an electrically conductive brush and the shield member in Embodiment 3.
Figure 10:
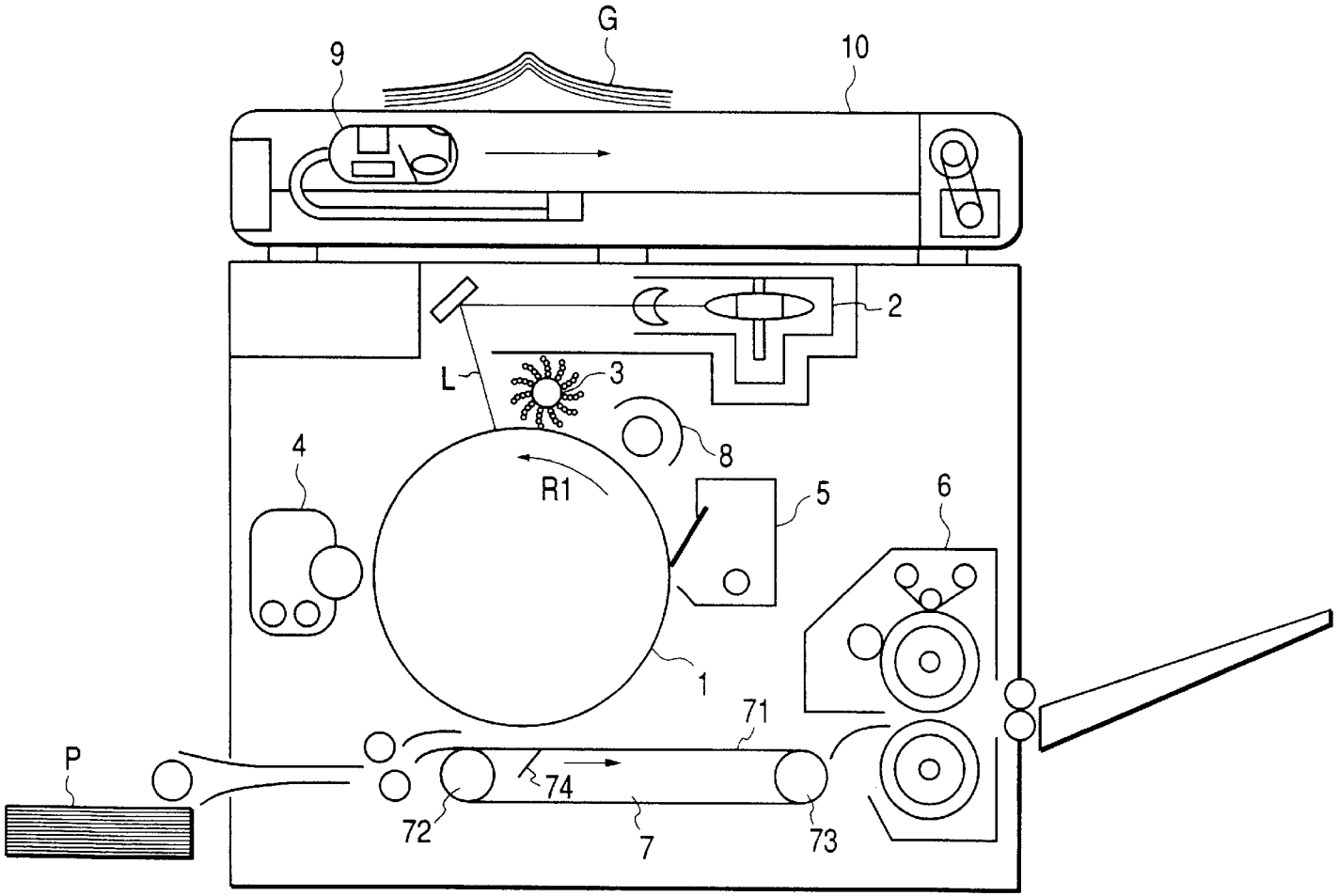
FIG. 10 is a longitudinal cross-sectional view schematically showing the construction of an image forming apparatus.
Figure 11:
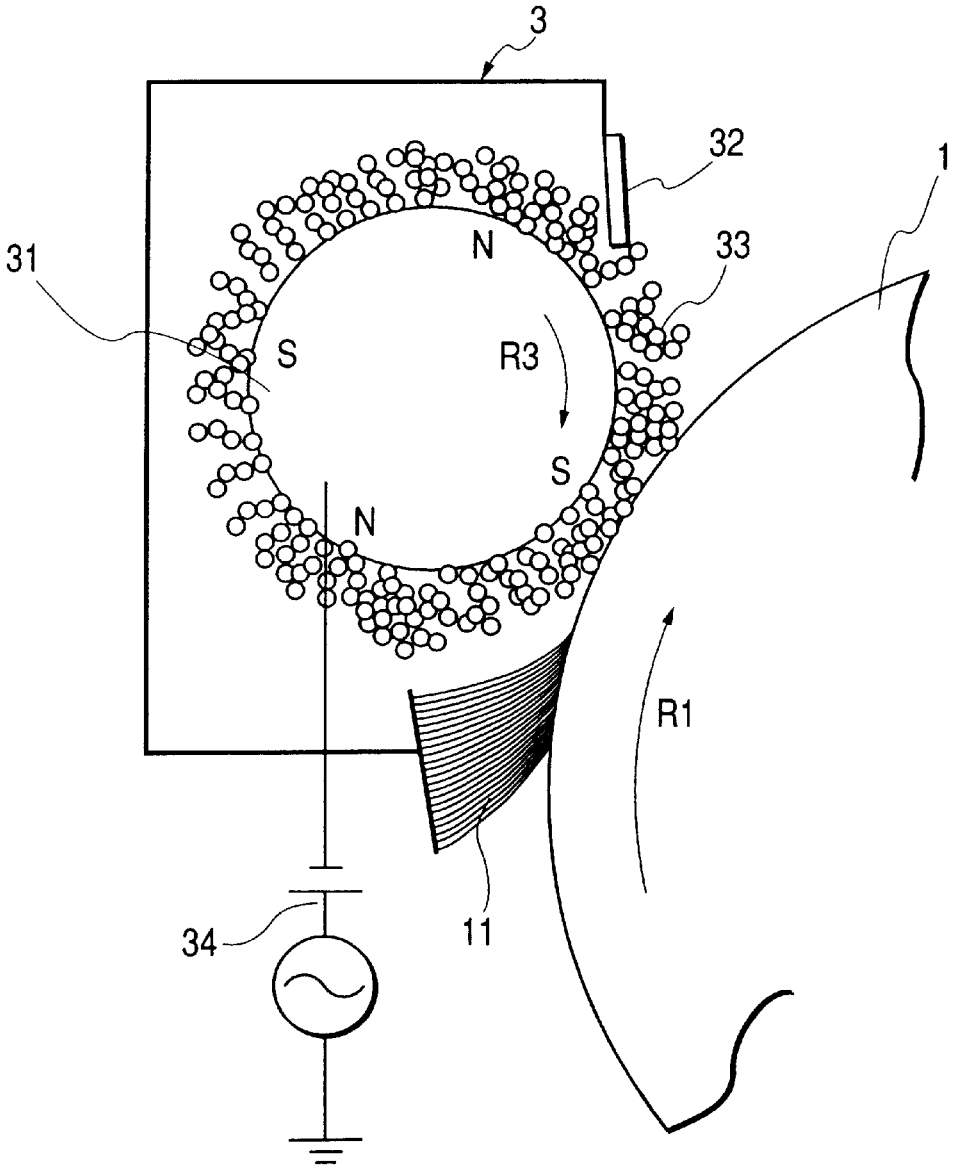
FIG. 11 shows the constructions of a magnetic brush charging device and an electrically conductive brush.

So, in the present embodiment, as shown in FIGS. 7 and 8, a shield member (a second shield member) 13 similar to the shield member 12 in the aforedescribed Embodiment 1 is also provided on the transfer device 7 side. In the other points, the construction of the present embodiment is similar to that of Embodiment 1.

However, when by the image forming operation, the brush hair of the electrically conductive brush 11 is inclined with the rotation of the photosensitive drum 1 and a gap is formed between the shield member 13 and the brush, the toner accumulates in the gap and as the result, the toner drops. Thus, it is desirable that as shown in FIG. 8, the shield member 13 be inclined toward the electrically conductive brush so that there may be no gap between the brush hair and the shield member 13 as far as possible. Thereby, it never happens that the toner adheres to that end portion of the electrically conductive brush which is adjacent to the transfer device 7 and therefore, the adhering toner can be prevented from dropping to thereby stain the user's hands or cause bad images to be formed.

Embodiment 4

Figure 9:
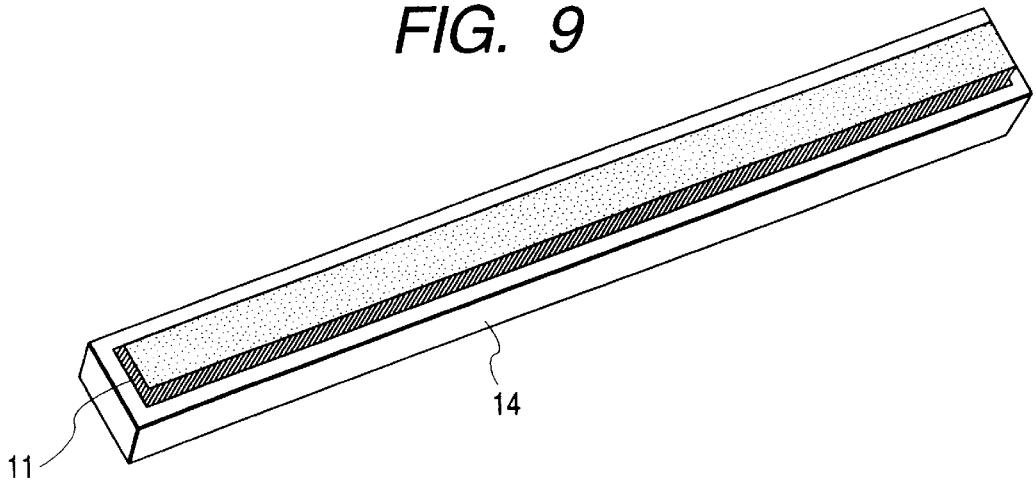
FIG. 9 is a perspective view showing the constructions of a magnetic brush and a shield member in Embodiment 4.

In Embodiment 4, as shown in FIG. 9, the shield member 12 in Embodiment 1 or 2 which is adjacent to the magnetic brush side of the electrically conductive brush 11 and the shield member 13 in Embodiment 3 on the transfer device 7 side are connected together at the lengthwisely opposite end portions thereof to form an electrically conductive brush cover 14 generally made into a unit, whereby the electrically conductive brush 11 is held. In the other points, the construction of the present embodiment is similar to that of Embodiment 1. Thereby, the construction around the electrically conductive brush 11 can be simplified. If for example, the electrically conductive brush cover 14 is made detachable from the magnetic brush charging device 3, the electrically conductive brush portion can be utilized as an interchangeable cartridge.

While the embodiments of the present invention have been described above, the present invention is not restricted to these embodiments, but all modifications are possible within the technical idea of the invention.

What is claimed is:

1. An image forming apparatus comprising:

an image bearing member bearing an electrostatic image thereon;

charging means for charging said image bearing member, said charging means being electrically conductive magnetic particles in contact with said image bearing member to thereby effect charging;

image forming means for forming an electrostatic image on said image bearing member charged by said charging means;

developing means for developing the electrostatic image on said image bearing member by a toner;

transfer means for transferring the toner image on said image bearing member to a transfer material;

auxiliary charging means provided near said transfer means side of said charging means for charging the residual toner after transfer to a polarity opposite to a charging polarity of said charging means, wherein the magnetic particles temporarily collects the residual toner; and a shield member for shielding said charging means and said auxiliary charging means.

2. An image forming apparatus according to claim 1, wherein said developing means collects the residual toner on said image bearing member after the transfer.

3. An image forming apparatus according to claim 1, wherein said auxiliary charging means comprises an auxiliary charging member contacting with said image bearing member.

4. An image forming apparatus according to claim 1, wherein said charging means applies to the magnetic particles a voltage including a direct current and an alternating current superposed one upon the other.

5. An image forming apparatus according to claim 1, wherein said shield member prevents the toner from accumulating on said charging means.

* * * * *

UNITED STATES PATENT AND TRADEMARK OFFICE

CERTIFICATE OF CORRECTION

PATENT NO. : 6,219,509 B1
DATED : April 17, 2001
INVENTOR(S) : Yoshiyuki Komiya et al.

It is certified that error appears in the above-identified patent and that said Letters Patent is hereby corrected as shown below:

Column 2,
Line 22, "is" should read -- are --; and
Line 62, "once" should read -- first --.

Column 3,
Line 9, "occuring" should read -- occurring --.

Column 7,
Line 27, "ear" should read -- "ear" --; and
Line 29, "ear" should read -- an ear, --; and
Line 40, "dignity" should read -- quality --.

Column 12,
Line 15, "collects" should read -- collect --.

Signed and Sealed this

Fourth Day of December, 2001

*Attest:*

Nicholas P. Godici

*Attesting Officer*

NICHOLAS P. GODICI
*Acting Director of the United States Patent and Trademark Office*